5/4/76 OR SR 3,955,202

United States Patent [19]

Young

[11] 3,955,202

[45] May 4, 1976

[54] CIRCULARLY POLARIZED WAVE LAUNCHER

[75] Inventor: Paul T. K. Young, Westwood, Mass.

[73] Assignee: Microwave Development Labs. Inc., Natick, Mass.

[22] Filed: Apr. 15, 1975

[21] Appl. No.: 568,280

[52] U.S. Cl. ..... 343/756; 333/21 A; 343/786

[51] Int. Cl.[2] ..... H01Q 13/02; H01Q 19/00; H01P 1/16

[58] Field of Search ..... 333/21 R, 21 A; 343/756, 786

[56] References Cited

UNITED STATES PATENTS

| | | | |
|---|---|---|---|
| 2,943,324 | 6/1960 | Sichak | 343/786 X |
| 3,530,482 | 9/1970 | Palmer | 343/786 |
| 3,566,309 | 2/1971 | Ajioka | 333/21 R X |
| 3,815,136 | 6/1974 | Rootsey | 343/786 X |

*Primary Examiner*—Paul L. Gensler
*Attorney, Agent, or Firm*—Wolf, Greenfield & Sacks

[57] ABSTRACT

A compact device for launching circularly polarized electromagnetic waves utilizes a hollow waveguide terminated by a horn. Within that structure, a septum fin extends from the waveguide into the horn. The septum fin divides the hollow waveguide into two smaller waveguides, each of which is capable of independently supporting the $TE_{1,0}$ mode of wave propagation. The fin is a tapered plate that has its maximum width within the waveguide and its minimum width in the horn. A signal injected into one port of the divided waveguide emerges from the horn as a circularly polarized wave having its polarization vector rotating clockwise whereas a signal injected into the other port emerges from the horn as a circularly polarized wave with its polarization vector rotating in the counter clockwise direction.

5 Claims, 4 Drawing Figures

CIRCULARLY POLARIZED WAVE LAUNCHER

BACKGROUND OF THE INVENTION

One of the factors determining the effective range of a radar system is the polarization of the radiated electromagnetic waves. Radiation of vertically or horizontally polarized electromagnetic waves during normal weather conditions gives good target returns. However, the individual droplets in a dense fog or in rainy weather act as targets and reflect the electromagnetic energy so that the range of the system is substantially reduced. Further, the returns from the droplets make it difficult to distinguish rain returns from a true target. To overcome that difficulty, the radiated electromagnetic wave can be polarized so that the returns from symmetrical targets can be differentiated from the returns from non-symmetrical targets. This is accomplished by radiating circularly polarized wave energy. By radiating circularly polarized energy, the returns from symmetrical targets can be made to cancel whereby the returns from asymmetrical targets are readily observed. When circular polarization is employed, the returns from asymmetrical targets are generally weaker than returns from plane polarized waves but the elimination of much of the interference from rain and fog has proven the value of circular polarization in radar, and especially in those applications where maximum range is not an important factor.

There are a number of methods for causing electromagnetic energy to be circularly polarized. The device that causes vertically or horizontally polarized waves to be converted into circularly polarized waves is known as the "polarizer". A conventional polarizer may, for example, employ a dielectric slab disposed diagonally across a square or circular section of waveguide. The dielectric slab polarizer must be of such length as to cause a differential phase shift of 90° in one component of the electromagnetic wave relative to the other component. Another type of polarizer uses a tapered fin polarizer such as is shown in U.S. Pat. No. 3,500,460. In that type of polarizer, the tapered fin is centrally situated in a hollow square waveguide and must be of such length as to cause a 90° differential phase shift in the guide. Both of the foregoing types of polarizers require the 90° phase shift to be accomplished within the waveguide and therefore the polarizer cannot be shorter than the waveguide length necessary to obtain the requisite 90° differential phase shift.

Radiation of circularly polarized wave energy into space is usually accomplished in radar applications by means of a horn. For efficient transmission, the horn must be matched to the output of the polarizer. Thus, an impedance matching section may be required between the output of the polarizer and the input to the horn. In any event, the usual circularly polarized wave energy launcher is at least as long as the combined lengths of the polarizer and the horn and will usually be longer to accommodate matching or transforming structures.

In many applications, it is desirable to employ a circularly polarized wave energy launcher that is as compact as possible. For example, where the device is to be employed in an automobile as a collision alarm radar, available space in the vehicle may necessitate a compact wave launcher. In other applications, such as police radar, it is desirable to have the radar set as unobtrusive as possible. Furthermore, a consideration reduction in the size of a wave energy launcher makes small hand carried radar sets realizable with the present state of the electronics art.

THE INVENTION

The invention resides in a circularly polarized wave energy launcher having a significant reduction in length achieved by utilizing the horn as a portion of the polarizer. In the invention, a septum fin is disposed in a hollow waveguide and extends into the horn which flares out from the waveguide. The hollow waveguide is divided by the septum fin into two smaller waveguides, each of which is capable of independently supporting the $TE_{1,0}$ mode of wave propagation. The fin is a tapered plate which acts as one of the broad walls of the two smaller waveguides. The fin has its maximum width in the waveguide and decreases in width to its minimum width in the horn. By properly selecting the extent of protrusion of the fin into the horn and the angle of taper of the fin, the waveguide can be matched to the horn while maintaining the length of waveguide and horn structure unchanged. The angle of taper of the septum fin is critically dependent upon the aperture of the horn. It has been found that by terminating the fin in a blunt end rather than in a sharp point, mode purity can be improved and better matching can be attained.

THE DRAWINGS

The invention, both as to its construction and its mode of operation, can be better understood from the following exposition when it is considered together with the accompanying drawings in which.

DETAILED DESCRIPTION OF THE PREFERRED EMBODIMENTS

Figure 1:
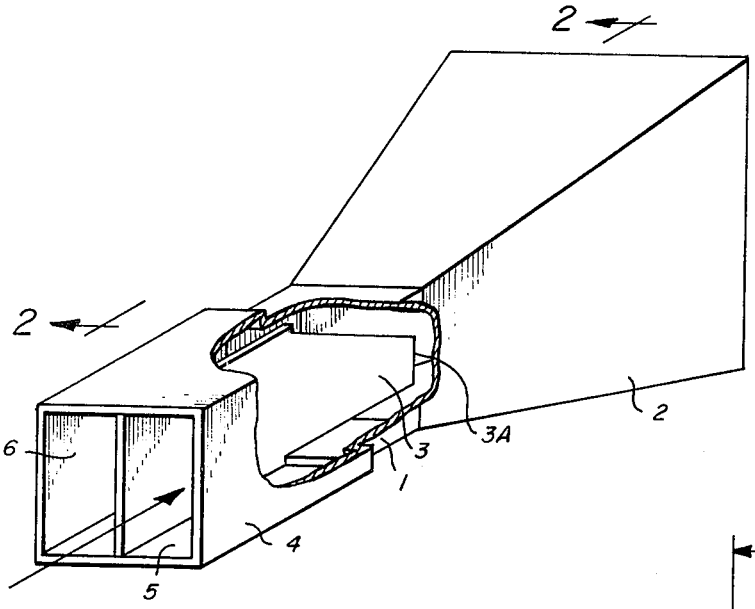
FIG. 1 is a perspective view of the preferred embodiment of the invention with parts broken away to reveal the tapered fin of the polarizer.
Figure 2:
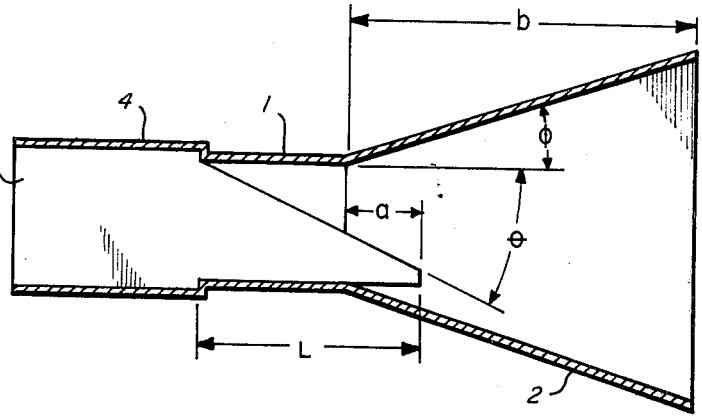
FIG. 2 is an elevational view, in cross-section of the preferred embodiment.

Referring now to FIGS. 1 and 2 of the drawings, the preferred embodiment of the invention employs a square hollow main waveguide 1 having a pyramidal horn 2 extending from one of the waveguide's ends. The wave energy emerging from the structure is radiated into space by the horn. As is well known, the horn has a directional effect that enables the radiated waves to be aimed in direction.

Centrally disposed in the waveguide 1 is a tapered fin 3 that protrudes from the waveguide into the horn. The angle $\theta$ at which the fin is tapered is critical to the correct operation of the polarizer and is dependent upon the aperture of the horn. The angle $\theta$ and the extent of protrusion of the fin into the horn can be varied to obtain precise circular polarization. The fin, in the preferred embodiment does not taper to a point but rather the narrowing end is truncated to provide a blunt end 3A. It has been found that mode purity can be improved and better matching of the waveguide to the horn can be achieved by terminating the fin in a blunt end rather than in a sharp point.

The tapered fin, as can be seen in FIG. 2, has its narrowest width in the horn and gradually increases in width until both edges of the fin meet the walls of the waveguide 1. For purposes of impedance matching, the square waveguide is stepped to a larger size at the point where the sloping edge of the fin meets the waveguide wall. At that point, the fin extends completely across the main waveguide. At and beyond that point, the septum fin acts as a solid partition that divides the square waveguide 4 into two smaller waveguides. The fin is an electrically conductive plate that acts as the common broad wall for the two smaller waveguides. Each of the two smaller waveguides 5 and 6 is capable of independently supporting the $TE_{1,0}$ mode of wave propagation.

In the $TE_{1,0}$ mode, the wave energy, as is well known, is linearly polarized. Wave energy which enters the input port of waveguide 5, as indicated by the arrow in FIG. 1, and propagates along the guide in the dominant $TE_{1,0}$ mode will, in passing through the tapered fin section, be converted to circularly polarized wave energy having its polarization vector rotating in one direction. Wave energy which enters the input port of waveguide 6 and propagates along that guide in the dominant $TE_{1,0}$ will be converted to circularly polarized wave energy having its polarization vector rotating in the opposite direction. Consequently, the wave energy radiated into space by the horn will be circularly polarized and the direction of rotation of the polarization vector will be determined by which of the two input ports is energized.

A compact circularly polarized wave energy launcher for operation at 10.525 $GH_Z$ with a 5% bandwidth was constructed substantially in the form depicted in FIGS. 1 and 2. The waveguide 1 was a 1 inch long section of square waveguide having internal dimensions of 0.800 × 0.800 inch and was secured to the waveguide 4 which was a section of square waveguide of 0.900 × 0.900 inch internal dimensions. The septum fin 3 was of the configuration depicted in FIG. 2 and tapered at an angle $\theta$ of 26° over a length L of 1.46 inches. The fin was a 0.050 inch thick plate and extended into the horn for a distance $a$ of 0.46 inch. As indicated, the horn was of pyramidal shape with a flare $\phi$ of 17° 28 minutes and was 2.30 inches long in the dimension $b$ in FIG. 2. By scaling techniques that are well known in the electronics art, the foregoing dimensions can be changed to provide a polarized wave energy launcher for operation at other frequencies.

Figure 3:
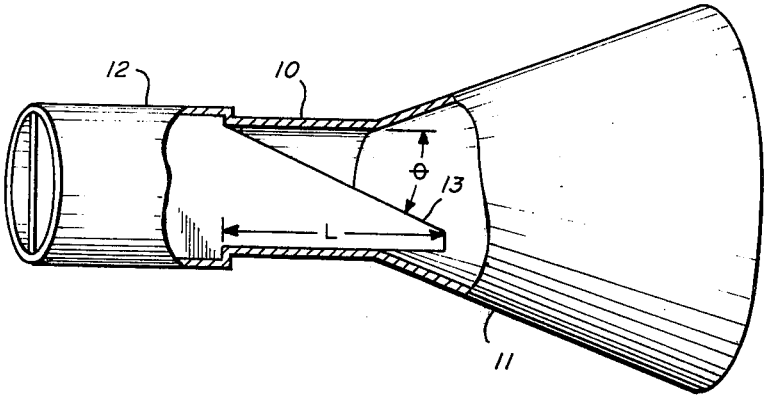
FIG. 3 is a perspective view of an embodiment of the invention employing a circular waveguide and a conical horn.
Figure 4:
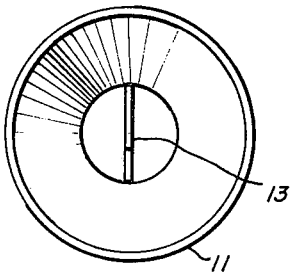
FIG. 4 is a view of the FIG. 3 embodiment as seen from the front of the horn.

While the preferred embodiment employs square waveguide, the use of square waveguide is not an essential of the invention and any waveguide configuration can be used which supports the $TE_{1,0}$ mode. Thus, in FIGS. 3 and 4, an embodiment of the invention is depicted employing a section 10 of circular waveguide having a conical horn 11 secured to one end. The other end of waveguide 10 is secured to a section 12 of circular waveguide which is of larger internal diameter. Centrally situated in the two waveguide sections is a septum fin 13 which protrudes from the waveguide 10 into the conical horn 11. At the juncture where waveguide 12 steps down to waveguide 10, one edge of the septum fin commences to slant at an angle $\theta$. The length L of the tapered portion of the septum fin is such that a 90° differential phase shift occurs in wave energy proagating toward the exit aperture of the horn. The circular waveguide 12 is partitioned by the septum fin 13 into two smaller semicircular waveguides, each of which is capable of independently supporting the $TE_{1,0}$ mode of wave propagation. As is known, a rectangular guide is better able to support the $TE_{1,0}$ mode than a semi-circular guide and therefore the attenuation per unit length is higher in the semi-circular guide. Inasmuch as the semi-circular guide can be relatively short in the wave launcher, the attenuation in the semi-circular guide is not a significant consideration. Thus an embodiment can be constructed in accordance with FIGS. 3 and 4 in which circular waveguide is employed. Where an appreciable length of guide is needed for transmission of the wave energy, a rectangular guide can be used immediately in front of the circular waveguide.

The invention can be embodied in varied structures and it is not intended that the invention be limited to the precise forms here illustrated and described. Rather, it is intended that the invention be delimited by the appended claims and include those structures that do not fairly depart from the essence of the invention.

I claim:

1. Apparatus for launching circularly polarized electromagnetic waves comprising a main waveguide having a horn extending from one end thereof, a septum fin centrally disposed in the main waveguide, the septum fin dividing the main waveguide into two subsidiary waveguides each of which is capable of independently supporting the $TE_{1,0}$ mode of wave propagation, the septum fin tapering in width within the main waveguide whereby a progressively enlarged opening is provided between the two subsidiary waveguides which widens in the direction toward the horn and causes a component of the wave energy propagating in the subsidiary waveguides to be shifted in phase relative to another component of that wave energy, and the tapering septum fin protruding from the main waveguide into the horn so that the septum fin has its minimum width in the horn.

2. Apparatus according to claim 1 for launching circularly polarized electromagnetic waves, wherein the tapered fin is a thin electrically conductive plate that forms a common broad wall for the two subsidiary waveguides and the narrow end of the fin is terminated in a blunt end.

3. A compact device for launching circularly polarized electromagnetic waves comprising 1. a rectangular main waveguide,
2. a pyramidal horn extending from one end of the main waveguide, and
3. a septum fin centrally situated in the main waveguide and forming a wall dividing the main waveguide into two subsidiary rectangular guides each of which is capable of independently supporting the $TE_{1,0}$ mode of wave propagation, the septum fin tapering in width within the main waveguide whereby a progressively enlarged opening is provided between the two subsidiary guides which widens in the direction toward the horn and causes a component of the wave energy propagating in the subsidiary guides to be shifted in phase relative to another component of that wave energy, the tapered septum fin extending into the pyramidal horn and tapering uniformly from its maximum width within the main waveguide to its minimum width in the horn.

4. The compact device according to claim 3, wherein the rectangular waveguide is stepped down in width at the point where the septum fin starts to taper toward the horn.

5. The compact device according to claim 3, wherein the rectangular waveguide has two contiguous square waveguide sections of different internal dimensions, the septum fin decreasing in width at the step between the contiguous sections and tapering in width therefrom toward the horn.

* * * * *